US005829710A

United States Patent [19]

Halle et al.

[11] Patent Number: 5,829,710

[45] Date of Patent: Nov. 3, 1998

[54] SHEET MATERIAL DISPENSER

[76] Inventors: Ray Halle, 78 Old Farm Rd., South Windsor, Conn. 06074; Martial LaRoche, 25 Pettengill Rd., Marlborough, Conn. 06447

[21] Appl. No.: 700,315

[22] Filed: Aug. 19, 1996

[51] Int. Cl.[6] ..... B65H 16/02

[52] U.S. Cl. ..... 242/595.1; 242/129; 206/408

[58] Field of Search ..... 242/595, 595.1, 242/599.1, 596.4, 129, 615.2; 206/408, 409, 389

[56] References Cited

U.S. PATENT DOCUMENTS

| | | | |
|---|---|---|---|
| 1,204,011 | 11/1916 | Greene | 242/595.1 X |
| 1,390,632 | 9/1921 | Metzger | 242/595.1 X |
| 1,899,625 | 2/1933 | Metts | 242/595 X |
| 2,319,071 | 5/1943 | Mason | 242/595 X |
| 2,458,844 | 1/1949 | Foote . | |
| 2,721,710 | 10/1955 | Birchler et al. | 242/595.1 X |
| 2,803,339 | 8/1957 | Kuchenbecker . | |
| 3,129,813 | 4/1964 | Norvelle | 242/595 X |
| 3,170,652 | 2/1965 | Kennedy | 242/599.1 |
| 3,262,620 | 7/1966 | Burt et al. . | |
| 3,318,443 | 5/1967 | Hillis | 242/595 X |
| 3,685,642 | 8/1972 | Benigno et al. . | |
| 3,685,684 | 8/1972 | Schindler et al. | 206/408 X |
| 3,760,975 | 9/1973 | Nilsson . | |
| 3,770,221 | 11/1973 | Stern | 242/599.4 X |
| 4,453,634 | 6/1984 | Blumenthal | 206/389 |
| 4,649,693 | 3/1987 | Yeager | 242/595.1 X |
| 4,651,910 | 3/1987 | DeGroot | 206/409 X |
| 4,669,242 | 6/1987 | Johnson et al. . | |
| 4,771,884 | 9/1988 | Lamborn et al. . | |
| 4,978,085 | 12/1990 | Letourneau | 242/595.1 X |
| 5,222,678 | 6/1993 | Carrington | 242/599.1 X |
| 5,267,705 | 12/1993 | Hofrichter et al. | 242/129 |

FOREIGN PATENT DOCUMENTS

| | | | |
|---|---|---|---|
| 715390 | 12/1931 | France | 242/595.1 |
| 002112436A | 9/1971 | Germany . | |
| 122312 | 3/1919 | United Kingdom | 242/599.1 |

OTHER PUBLICATIONS

Advertisement of Tapco Products Company "Professional Cut–Off" machine published in 1995.

Advertisement of Tapco International Corp. "Professional Side–Winder Coil Holder & Cut–Off System" published in 1996.

*Primary Examiner*—Donald P. Walsh
*Assistant Examiner*—William A. Rivera
*Attorney, Agent, or Firm*—Fishman, Dionne, Cantor & Colburn

[57] ABSTRACT

A sheet material dispenser for dispensing rolls aluminum coilstock. The sheet material dispenser is made from plastic and includes a front door that renders the sheet material dispenser substantially weatherproof. A rain overhang extends over the edge of the door to prevent water from entering the sheet material dispenser. A rear affixing tab allows the sheet material dispenser to be attached to a work table to facilitate working with the coilstock. The interior of the sheet material dispenser includes rollers that ease dispensing of the coilstock.

13 Claims, 7 Drawing Sheets

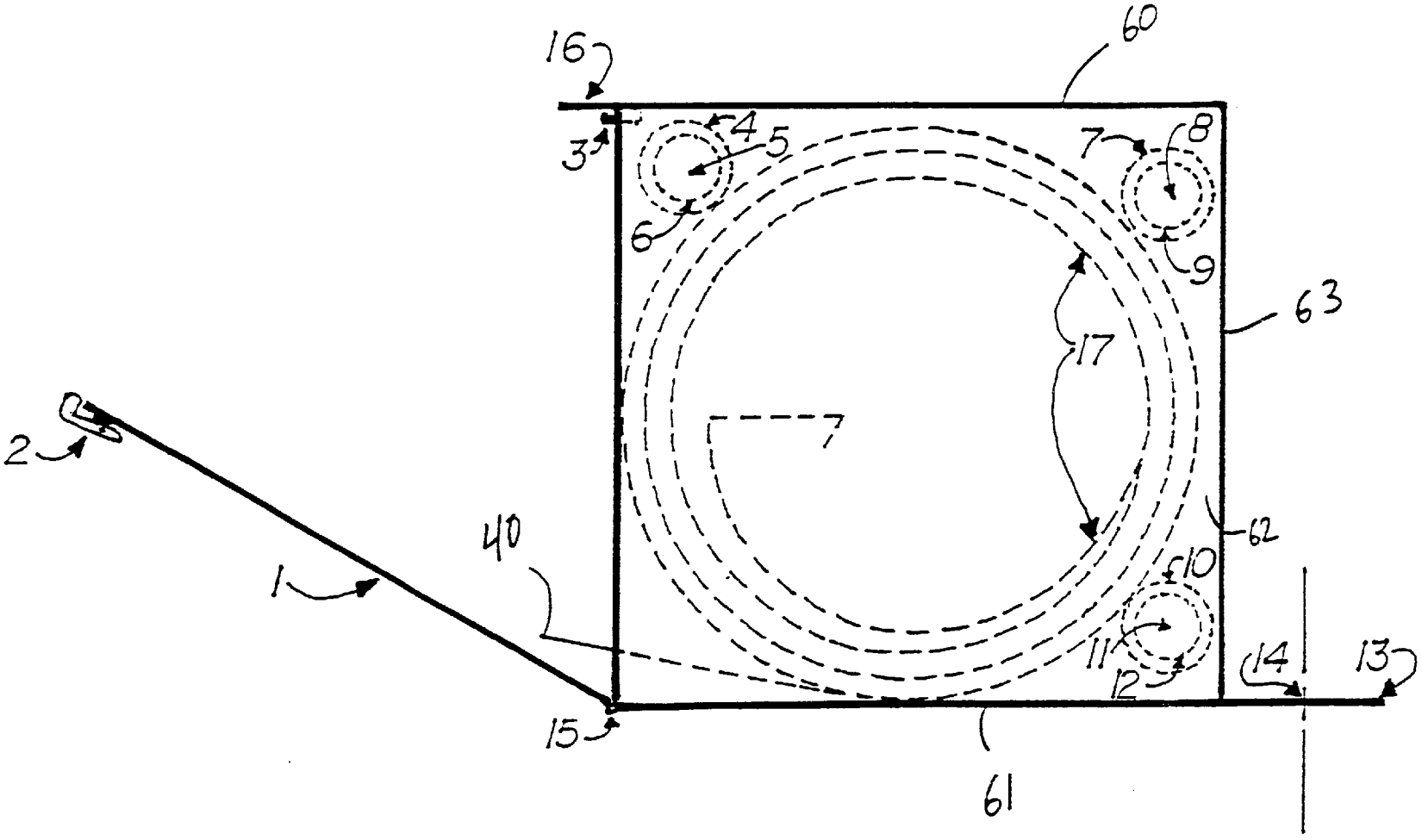
KOILPAC FIGURE 1A

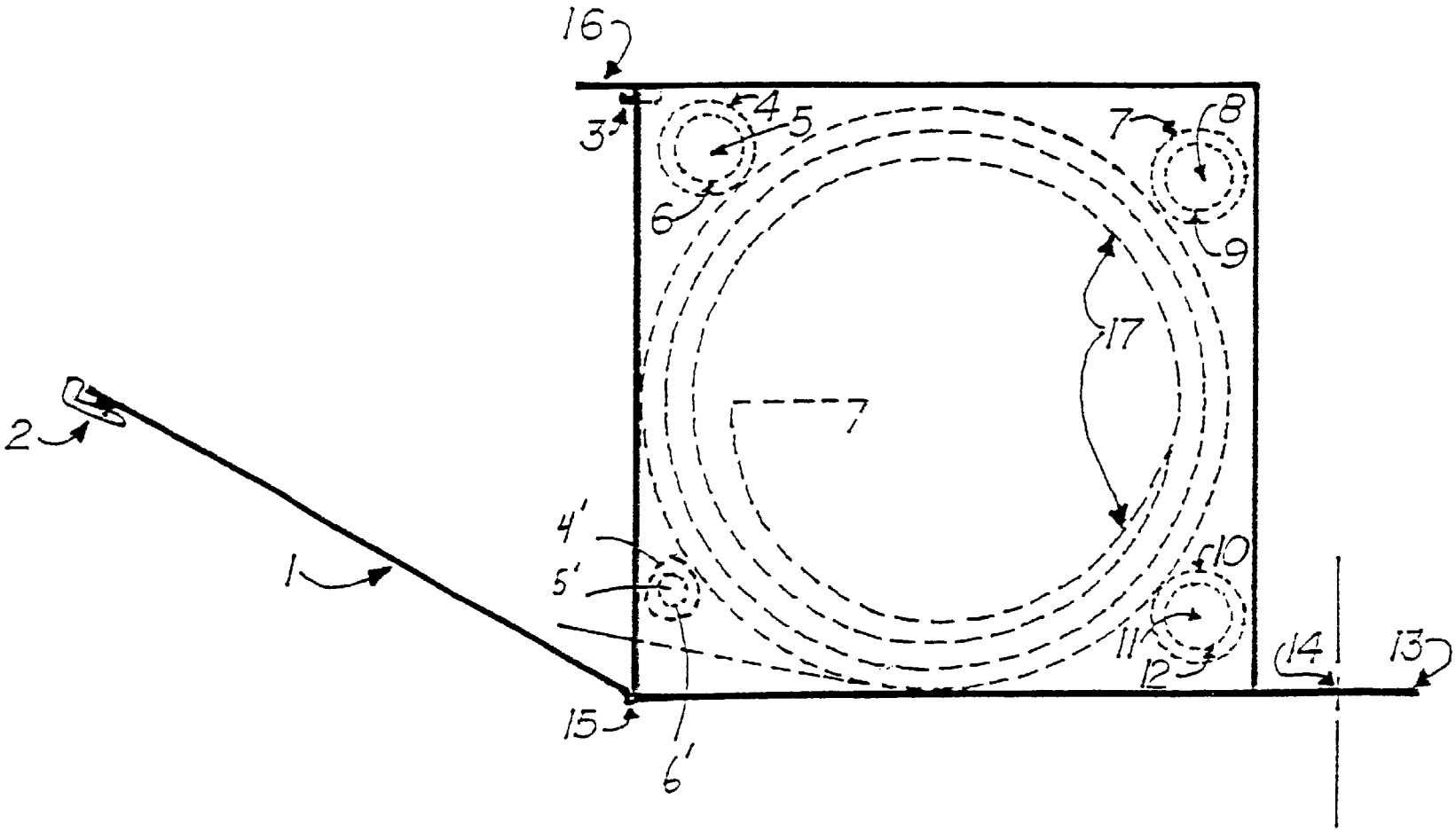
KOILPAC FIGURE 1B

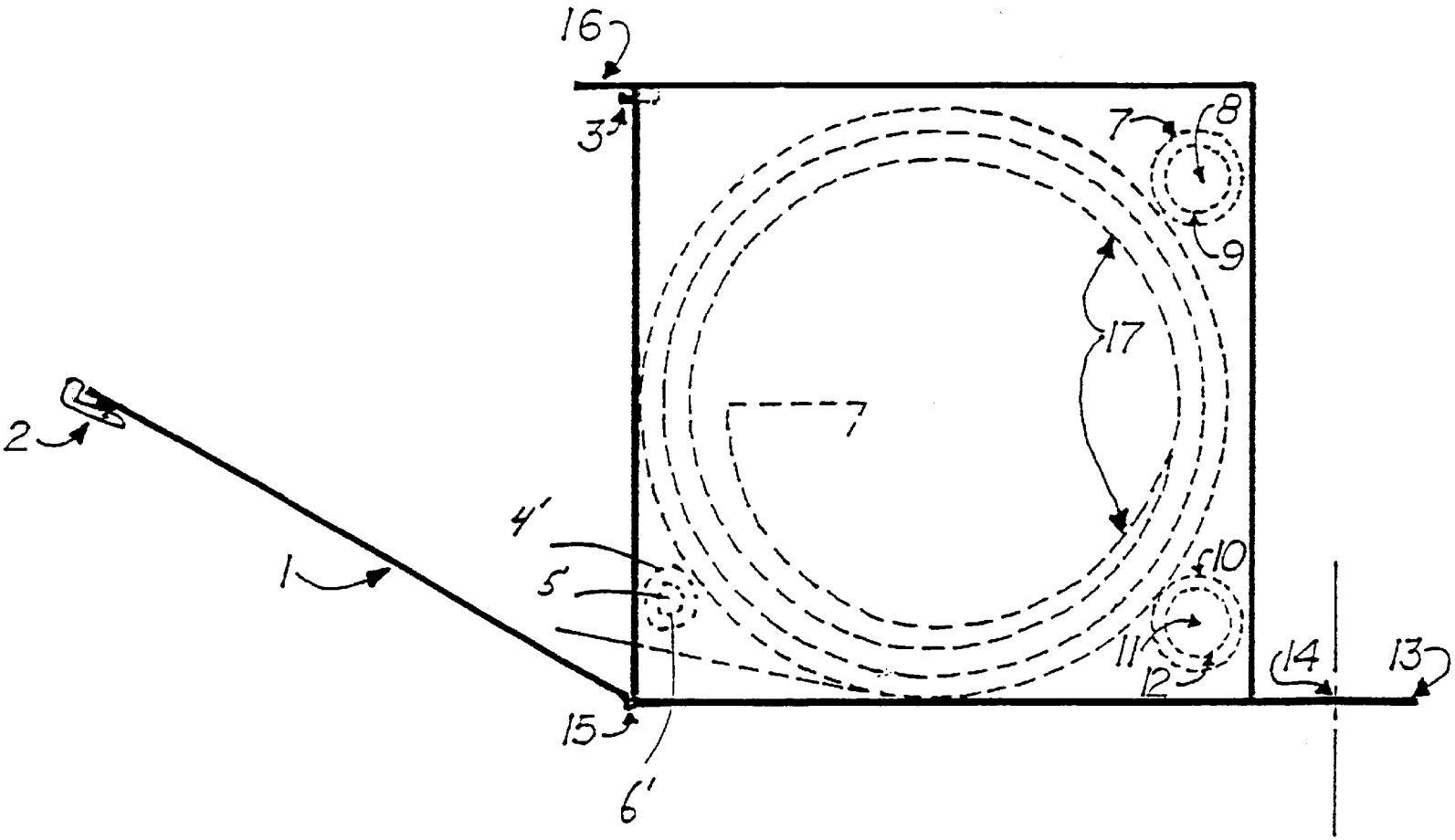
KOILPAC FIGURE 1C

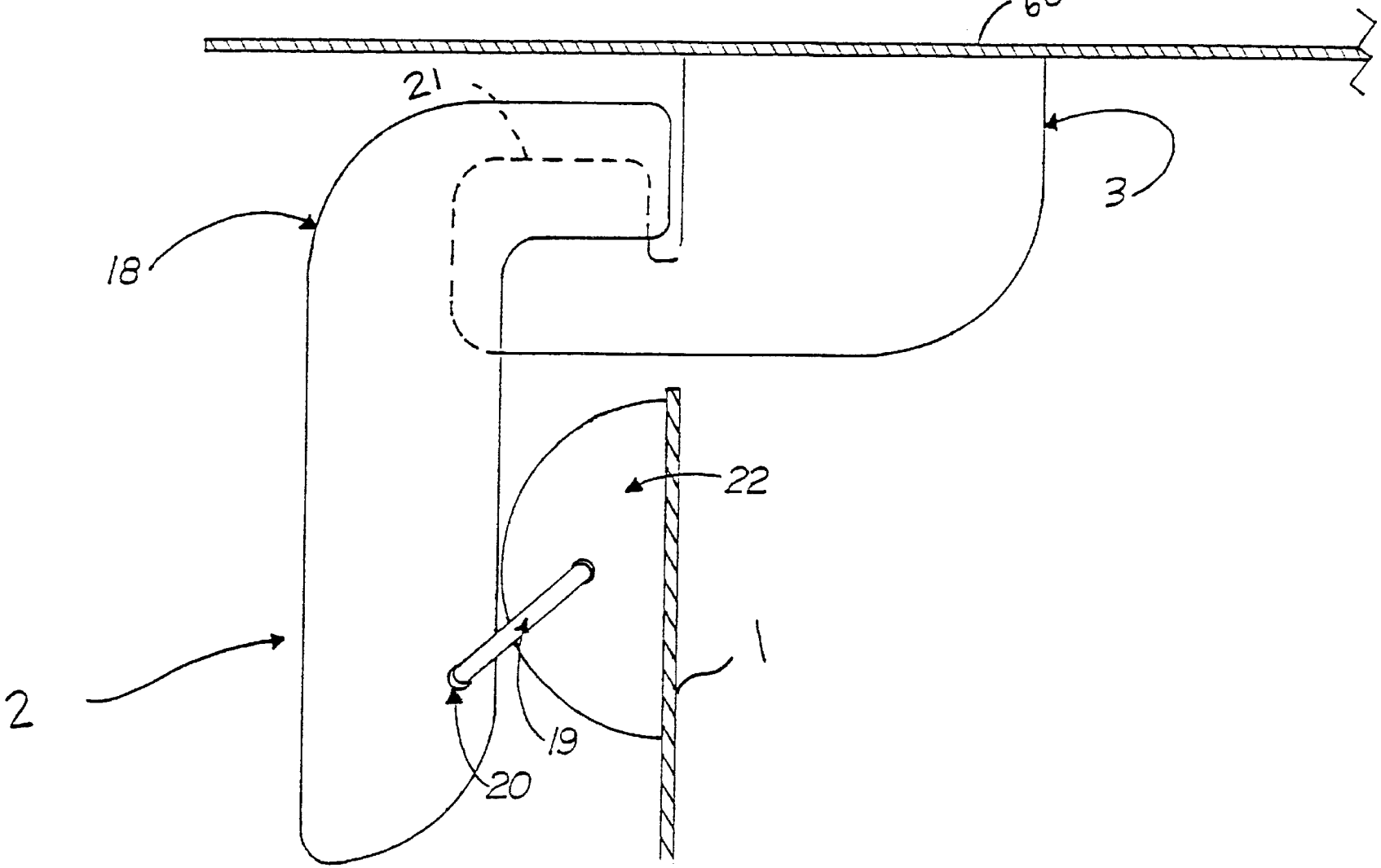
- FIGURE 2 -

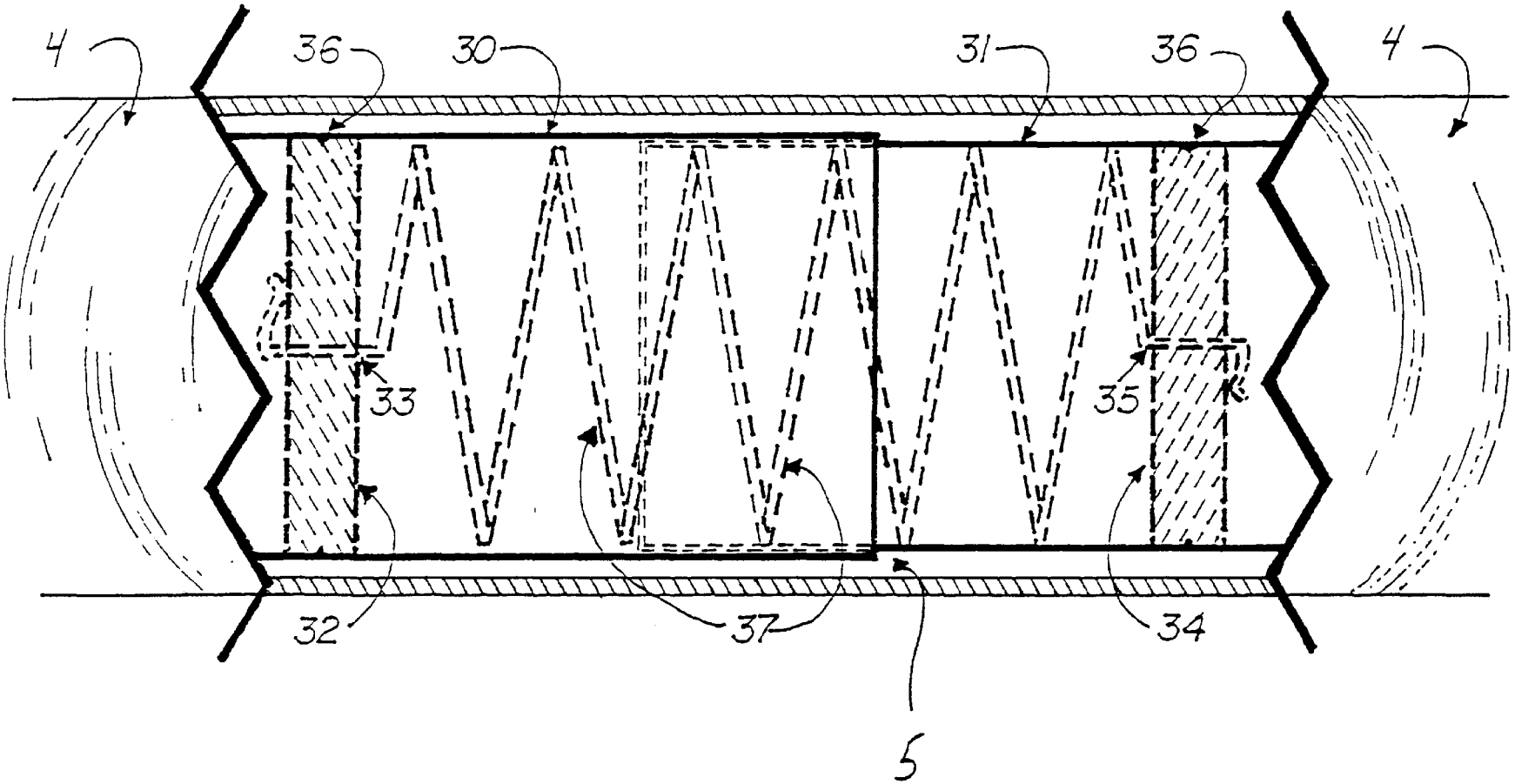
- FIGURE 4 -

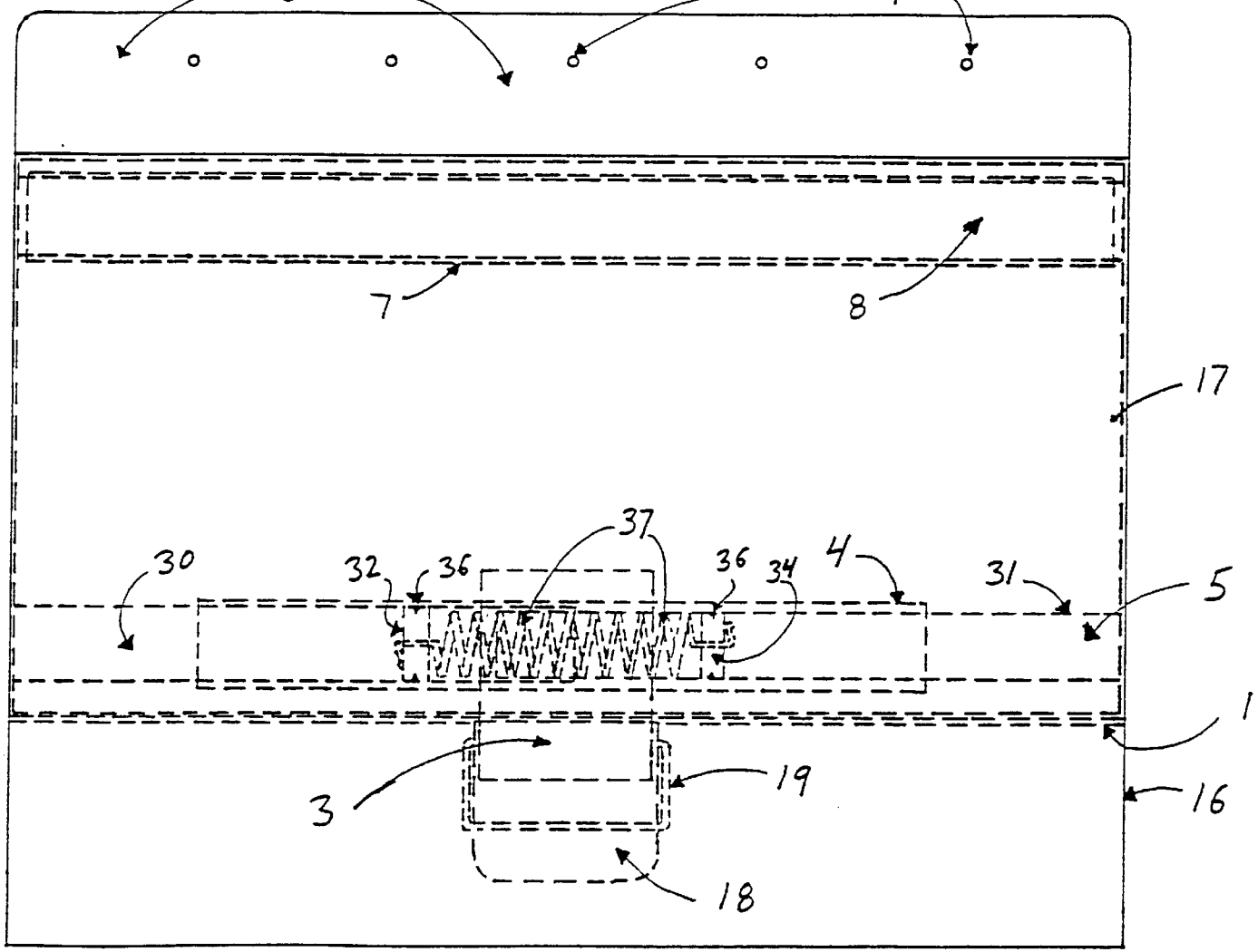
- FIGURE 5 -

SHEET MATERIAL DISPENSER

BACKGROUND OF THE INVENTION

1. Field of the Invention

The present invention relates generally to a dispenser for rolls of sheet material and in particular to a weatherproof dispenser for aluminum coilstock material.

2. Prior Art

Aluminum coilstock material is used for covering wood trim around doors, windows, soffits, gables, etc., of residences and their out buildings. Currently, the coilstock material is delivered to applicators in a cardboard carton. The majority of vinyl siding applicators and replacement window installers cut open the coilstock shipping carton and pull out the amount of coilstock needed. The cardboard carton holds the coilstock only as long as the cardboard remains stiff and holds its shape. If the carton is left to the weather, the carton will become weakened. Because the coilstock has the tendency to unwind, this often results in the coilstock breaking open the carton and rendering the carton useless. In addition, the coilstock may become wet which adds an extra step of wiping dry the coilstock so as to be able to work with it.

Some applicators remove the coilstock completely from its box, place the coilstock on a worktable and affix two bent nails to the sides of the coilstock to keep it in place while they attempt to roll it out. This usually results in scratched coilstock material, damaged edges and the need for a second person to hold the coilstock steady while unrolling.

SUMMARY OF THE INVENTION

The above-discussed and other drawbacks and deficiencies of the prior art are overcome or alleviated by the sheet material dispenser of the invention. The sheet material dispenser is a plastic dispenser box which houses rolled sheet material, such as aluminum coilstock. The weatherproof sheet material dispenser protects the coilstock by becoming substantially weather tight when closed and latched. The weatherproof sheet material dispenser also eases working with the coilstock. A rear affixing tab allows the weatherproof sheet material dispenser to be sturdily affixed to the work surface. The coilstock can then be easily rolled out by one person due to the low coefficient of friction of the plastic surface and roller sleeves in the front and rear of the dispenser.

BRIEF DESCRIPTION OF THE DRAWINGS

Referring now to the drawings wherein like elements are numbered alike in the several FIGURES:

FIGS. 1A–1C are side views of various embodiments of the present invention;

FIG. 2 is side view of the latch of the sheet material dispenser;

FIG. 4 is a partial cross-sectional view of a removable roller; and

FIG. 5 is a top view of the sheet material dispenser.

DETAILED DESCRIPTION OF THE INVENTION

Figure 3A:
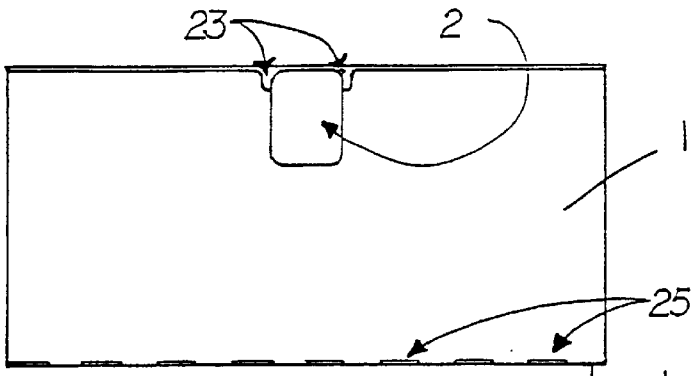
FIGS. 3A–3C are respective front, perspective and side views of the door of the sheet material dispenser.

FIG. 1A is a side view of the sheet material dispenser in a first embodiment of the invention. The main portion of the sheet material dispenser is a plastic enclosure having a top

60, bottom 61, right side wall 62, a rear wall 63 and a left side wall 64. A door 1 is hingedly mounted to the bottom 61 through a hinge 15. In an exemplary embodiment, the door 1 is made from plastic. The details of the hinge 15 are described below with reference to FIGS. 3A–3C. The door 1 includes a latch 2 which engages a hasp 3 formed on the top 60 of the sheet material dispenser. The details of the latch 2 and hasp 3 are described below with reference to FIG. 2. The sheet material dispenser includes a rain overhang 16 that is an extension of top 60. The rain overhang 16 prevents water from entering the sheet material dispenser and renders the sheet material dispenser substantially weatherproof. This allows the applicator to leave the sheet material dispenser outside at the job site without the coilstock 17 becoming wet. The sheet material dispenser also includes a rear affixing tab 13 that is an extension of bottom 61. The rear affixing tab 13 includes preformed holes 14 that allow the applicator to mount the sheet material dispenser to a work table using fasteners such as wood screws.

The interior of the sheet material dispenser includes rollers at the front of the sheet material dispenser (closest to the door 1) and at the rear of the sheet material dispenser (closest to rear wall 63). The embodiment in FIG. 1A shows one top front roller, a top rear roller and a bottom rear roller. The top rear roller includes a dowel 8 and a sleeve 7 that is slightly shorter than the length of dowel 8. The sleeve 7 rotates about the dowel 8 to form a roller. In an exemplary embodiment, the dowel 8 is made from wood and the sleeve 7 is made from a plastic material. The interior of the sheet material dispenser includes intrusions 9 in the side walls 62 and 64 for receiving the dowel 8. A bottom rear roller includes a dowel 11, covered by sleeve 10, fitted into intrusions 12 formed in the side walls 62 and 64. In an exemplary embodiment, the dowel 11 is made from wood and the sleeve 10 is made from a plastic material. The top and bottom rear rollers prevent the coilstock 17 from binding against the interior surface of the sheet material dispenser.

The sheet material dispenser also includes a front removable roller including a front roller sleeve 4 and an adjustable dowel 5. The adjustable dowel 5 is fitted into intrusions 6 formed in the interior of side walls 62 and 64. The front roller can be removed by shortening the length of the adjustable dowel 5 so that the adjustable dowel 5 no longer engages the intrusions 6. The details of the adjustable dowel 5 are described below with reference to FIG. 4. A removable front roller is needed for two reasons; one, to insert the coilstock material 17 and two, to apply backward pressure to coilstock 17.

FIG. 1B is a side view of an alternative embodiment of the sheet material dispenser. In FIG. 1B, a bottom front roller has been added to the embodiment shown in FIG. 1A. The bottom front roller includes a sleeve 4' and a dowel 5' which is fitted into intrusions 6' formed in the interior of the side walls 62 and 64. FIG. 1C is another embodiment of the sheet material dispenser. In the embodiment shown in FIG. 1C, the top front roller has been eliminated.

FIG. 2 is a detailed side view of the latch 2 and hasp 3. The latch 2 includes a latch arm 18 which includes a recessed section 21 for receiving the end of hasp 3. An elongated latch bore 20 is formed in the latch arm 18 and receives a latch pin 19. The latch pin 19 couples the latch arm 18 to a latch mounting protrusion 22 formed on the door 1. The latch 2 is a loose friction snap-latch that brings the door 1 snug over the opening of the sheet material dispenser and hooks over a hasp 3. The door 1 is locked in place by applying downward pressure on the latch arm 18. It is understood that other latching mechanisms may be used such as a magnetic latch, a latch made from hook and loop type fabric, etc.

Figure 3B:
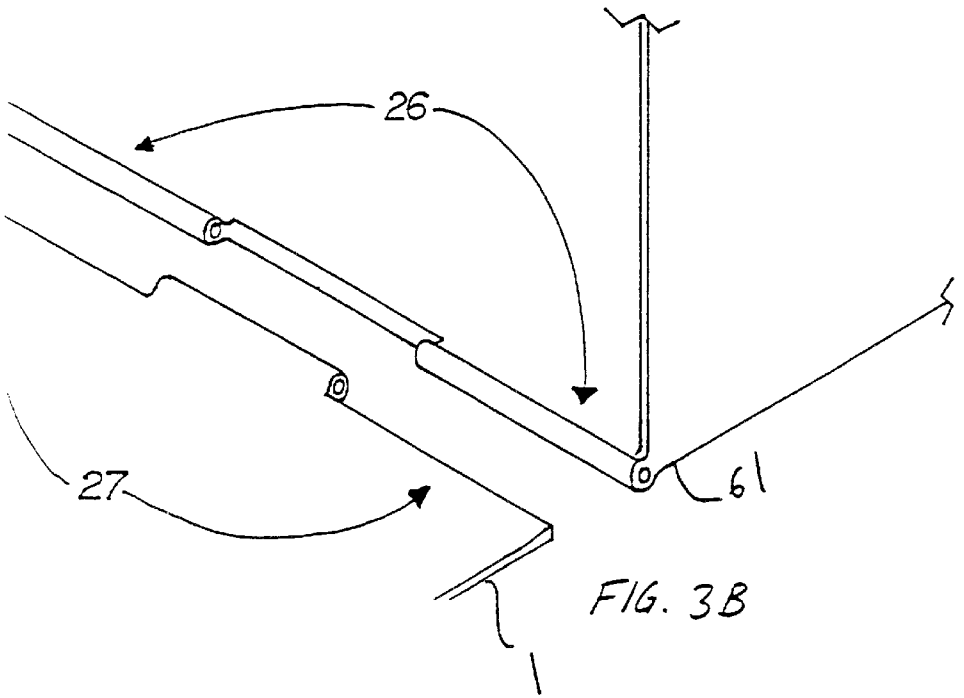
Figure 3C:
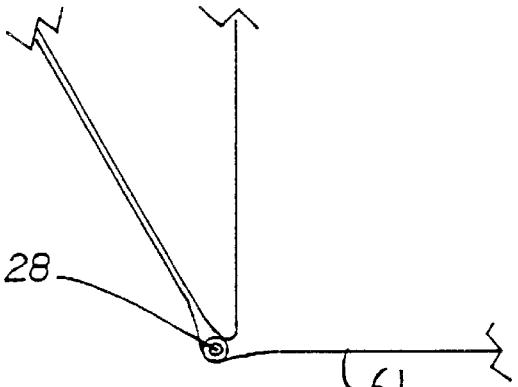

FIGS. 3A–3C are respective front, perspective and side views of the sheet material dispenser. FIG. 3A is a front view showing the door 1 in the closed position. The door 1 includes a recessed section 23 that provides clearance for the hasp 3. A continuous hinge 25 hingedly connects the door 1 to the bottom 61 to the sheet material dispenser. As shown in FIG. 3B, the bottom of the door 1 includes a series of raised and bored interlocking sections 27. The front of the bottom 61 also includes raised and bored interlocking sections 26. To hingedly mount the door 1 to the sheet material dispenser, the interlocking sections 27 and 26 are engaged to align the bores formed in the interlocking sections 26 and 27. A hinge pin 28 is placed through the aligned bores.

FIG. 4 is a detailed view of the adjustable front dowel shown generally at 5. As described above, the adjustable dowel 5 is covered by a sleeve 4. In an exemplary embodiment, the sleeve 4 is approximately one third the length of the adjustable dowel 5. This allows the length of the adjustable dowel 5 to be reduced without interference by sleeve 4. The adjustable dowel 5 is a two part tube comprising a larger diameter half 30 and a smaller diameter half 31. In an exemplary embodiment, the larger diameter tube 30 and the smaller diameter tube 31 are made from aluminum. The outer diameter of the smaller diameter tube 31 fits within the inner diameter of the larger diameter tube 30. Both the larger diameter tube 30 and the smaller diameter tube 31 are blocked inside by plugs 32 and 34, respectively. Crimps 36 are formed in the large diameter tube 30 and the smaller diameter tube 31 to hold the plugs 32 and 34 in place. Each of the plugs 32 and 34 include center holes 33 and 35 for receiving the ends of spring 37. The length of the adjustable dowel is adjusted by applying force to the ends of the adjustable dowel 5. This allows the adjustable dowel 5 to be inserted into and removed from the intrusions 6 formed in the side walls 62 and 64. FIG. 5 is a top view of the sheet material dispenser. The elements of the sheet material dispenser shown in FIG. 5 have been described above.

The operation of the sheet material dispenser will now be described. The sheet material dispenser is first mounted to a worktable or planks by using fasteners (such as wood screws) placed in the affixing holes 14 formed in the rear affixing tab 13. The door 1 is unlatched and laid flat on the work surface. The front adjustable roller is removed by grasping both ends of the aluminum tubes 30 and 31 and drawing them towards the center of the adjustable roller 5. The adjustable front roller is inserted into the sheet material dispenser in the same way. The coilstock 17 is slid into the sheet material dispenser with its leading edge 40 pointing out from the bottom of the sheet material dispenser as shown in FIG. 1. The adjustable front roller is then re-inserted and the coilstock 17 can then be pulled out of the sheet material dispenser to the length needed, measured and cut on the back of the door 1. When the door 1 is open and laid flat on the worktable, its inside surface becomes a cutting top for the coilstock 17.

The coilstock 17 can be re-inserted into the sheet material dispenser, the door 1 closed and the latch 2 grasped at its bottom and brought over the top of the hasp 3 and snapped down. The latch 2 and hasp 3 stay in this position by virtue of tension caused by the angle of the latch pin 19. The latch 2 includes a recessed region 21 that accepts the end of the hasp 3. To open the door 1, the latch 2 is grasped from the bottom, snapped upwards and pulled away from the hasp 3. With the door 1 closed and latched, the sheet material dispenser is substantially weatherproof.

The present invention provides an effective apparatus for dispensing sheet material, and in particular aluminum coilstock. The plastic construction and weatherproof design ensure the structural integrity of the sheet material dispenser and prevents the coilstock from becoming wet. A series of rollers allows the coilstock to be easily removed from the dispenser and the door also provide a cutting surface. The sheet material dispenser can be mounted to a work table to further ease dispensing of the coilstock.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A sheet material dispenser comprising:

an enclosure for containing the sheet material, said enclosure including a bottom, a first side wall connected to said bottom, a second side wall connected to said bottom, a rear wall connected to said first side wall, said second side wall and said bottom, and a top connected to said first side wall, said second side wall and said rear wall, said bottom, first side wall, second side wall, rear wall and top defining a five sided enclosure having an opening;

a planar door coupled to said enclosure being positionable in a closed position to seal said opening;

at least one removable roller within said enclosure for contacting said sheet material, said removable roller contacting said first side wall and said second side wall and being removable from said first side wall and said second side wall; and at least one rear roller wherein said removable roller includes:

a larger diameter tube;

a smaller diameter tube, a portion of said smaller diameter tube extending into said larger diameter tube; and a spring coupling said larger diameter tube and said smaller diameter tube, wherein said removable roller is removed upon compressing the smaller diameter tube into the larger diameter tube.

2. The sheet material dispenser of claim 1 further comprising at least one rear roller.

3. The sheet material dispenser of claim 2 wherein said at least one rear roller comprises a top rear roller and a bottom rear roller.

4. The sheet material dispenser of claim 3 wherein said at least one removable roller comprises a top removable roller a bottom removable roller.

5. The sheet material dispenser of claim 1 wherein said enclosure and said door are made from plastic.

6. The sheet material dispenser of claim 1 wherein the sheet material is aluminum coilstock.

7. The sheet material dispenser of claim 1 further comprising an affixing tab positioned at a junction between said bottom and said rear wall, said affixing tab including at least one hole for receiving a fastener.

8. The sheet material dispenser of claim 1 wherein said removable roller is removed solely upon compressing the smaller diameter tube into the larger diameter tube.

9. A sheet material dispenser comprising:

an enclosure for containing the sheet material, said enclosure including a bottom, a first side wall connected to said bottom, a second side wall connected to said bottom, a rear wall connected to said first side wall, said second side wall and said bottom, and a top connected to said first side wall, said second side wall and said rear wall, said bottom, first side wall, second side wall, rear wall and top defining a five sided enclosure having an opening;

a planar door having a first end hingedly coupled to said enclosure and being positionable in a closed position to seal said opening;

at least one removable roller within said enclosure for contacting said sheet material, said removable roller contacting said first side wall and said second side wall and being removable from said first side wall and said second side wall; and at least one rear roller wherein said removable roller includes:

a larger diameter tube;

a smaller diameter tube, a portion of said smaller diameter tube extending into said larger diameter tube; and a spring coupling said larger diameter tube and said smaller diameter tube, wherein said removable roller is removed upon compressing the smaller diameter tube into the larger diameter tube; and a rain overhang extending away from said top and covering a second edge of said door when said door is in the closed position.

10. The sheet material dispenser of claim 9 wherein said enclosure and said door are made from plastic.

11. The sheet material dispenser of claim 9 wherein the sheet material is aluminum coilstock.

12. The sheet material dispenser of claim 9 further comprising an affixing tab positioned at a junction between said bottom and said rear wall, said affixing tab including at least one hole for receiving a fastener.

13. A sheet material dispenser comprising:

an enclosure for containing the sheet material, said enclosure including a bottom, a first side wall connected to said bottom, a second side wall connected to said bottom, rear wall connected to said first side wall, said second side wall and said bottom, and a top connected to said first side wall, said second side wall and said rear wall, said bottom, first side wall, second side wall, rear wall and top defining a five sided enclosure having an opening;

a planar door having a first end hingedly coupled to said enclosure and being positionable in a closed position to seal said opening;

at least one removable roller within said enclosure for contacting said sheet material, said removable roller contacting said first side wall and said second side wall and being removable from said first side wall and said second side wall; said removable roller including:

a larger diameter tube;

a smaller diameter tube, a portion of said smaller diameter tube extending into said larger diameter tube; and a spring coupling said larger diameter tube and said smaller diameter tube, wherein said removable roller is removed upon compressing the smaller diameter tube into the larger diameter tube, wherein said removable roller is removed upon compressing the smaller diameter tube into the larger diameter tube;

a rain overhang extending away from said top and covering a second edge of said door when said door is in the closed position; and an affixing tab extending away from said bottom, said affixing tab including at least one hole for receiving a fastener.

* * * * *